US008551028B2

(12) United States Patent
Chen

(10) Patent No.: US 8,551,028 B2
(45) Date of Patent: Oct. 8, 2013

(54) FORCE SENSING MECHANSIM OF A MASSAGE MACHINE

(76) Inventor: Ko-Po Chen, Ta-Li (TW)

( * ) Notice: Subject to any disclaimer, the term of this patent is extended or adjusted under 35 U.S.C. 154(b) by 357 days.

(21) Appl. No.: 13/088,302

(22) Filed: Apr. 15, 2011

(65) Prior Publication Data

US 2012/0265112 A1 Oct. 18, 2012

(51) Int. Cl.
*A61H 15/00* (2006.01)
*A61H 7/00* (2006.01)
*A61H 19/00* (2006.01)

(52) U.S. Cl.
USPC ..... 601/115; 601/90; 601/98

(58) Field of Classification Search
USPC ..... 601/24, 49, 86, 90, 98, 115
See application file for complete search history.

(56) References Cited

U.S. PATENT DOCUMENTS

| | | | | |
|---|---|---|---|---|
| 5,792,080 | A * | 8/1998 | Ookawa et al. | 601/115 |
| 6,832,991 | B1 * | 12/2004 | Inada et al. | 601/99 |
| 6,911,012 | B2 * | 6/2005 | Kahn | 601/99 |
| 2002/0082534 | A1 * | 6/2002 | Jikiba et al. | 601/99 |
| 2004/0186398 | A1 * | 9/2004 | Furuie | 601/99 |
| 2005/0090767 | A1 * | 4/2005 | Kahn | 600/587 |
| 2006/0111653 | A1 * | 5/2006 | Nishio et al. | 601/84 |
| 2009/0254013 | A1 * | 10/2009 | Kajiyama et al. | 601/134 |

* cited by examiner

*Primary Examiner* — Kristen Matter

(57) ABSTRACT

A force sensing mechanism of the massage machine contains: a frame, a swing seat, a connecting member, and at least one sensing apparatus. The frame includes a rotary shaft fixed thereon and displaces vertically on a second sliding rail of a massage chair. The swing seat is connected with the rotary shaft and includes at least one roller. A first end of the connecting member is coupled with the swing seat, and a second end of the connecting member is connected with a first end of the stopping member, a second end of the stopping member is coupled on the frame. The at least one sensing apparatus is arranged on the frame relative to the stopping member so as to sense a movement of the stopping member, and the sensing apparatus is connected with a controller to transmit a sensing signal toward the controller so that the controller calculates a massage force of the at least one roller.

4 Claims, 13 Drawing Sheets

FORCE SENSING MECHANSIM OF A MASSAGE MACHINE

BACKGROUND OF THE INVENTION

1. Field of the Invention

The present invention relates to a force sensing mechanism of a massage machine that is capable of depicting every portion of a human body (such as the shoulder, the back, and the waist) to determine massage mode, thus increasing massage functions.

2. Description of the Prior Arts

As shown in FIGS. 1 and 2, a conventional angle adjusting mechanism of a massaging device of a massage machine is disclosed in TW Pat. No. 1326596, and the massaging device contains a frame 10 including a rotary 11, the rotary shaft 11 is axially connected with a wing seat 20, the swing seat 20 includes two first and two second rollers 21, 22, between the frame 10 and the swing seat 20 is defined the angle adjusting mechanism, wherein the angle adjusting mechanism 20 includes a motor 31 to drive a screw rod 33 of the swing seat 20 through a pulley seat 32, and the screw rod 33 is screwed with a vertical moving sleeve 43, the sleeve 34 is axially coupled with a connecting member 35, one end of which is in connection with the frame 10 axially. Referring the FIG. 2, in operation, the user's shoulder contacts with the first and the second rollers 21, 22, and the controller controls the motor 31 to drive the screw rod 33 to rotate via the pulley set 32 so that the screw rod 33 displaces upward along the sleeve 34, and the sleeve 34 is adjusted toward a suitable angle with a tilted angle of the screw rod 33 so that the screw rod 33 actuates a rear end of the swing seat 20 to swing upward, thereafter the swing seat 20 swings forward and rearward by using the rotary shaft 11 as its fulcrum, such that the first and the rear rollers 21, 22 extend forward to adjust angles respectively, thus massaging the user's shoulder in a should massage mode.

With reference to FIG. 3, since the curve lines of the shoulder, the back, and the waist are different, when the first and the second rollers 21, 22 move downward to the back or the waist so as to massage, the controller controls the screw rod 33 to drive the swing seat 20 so that the swing seat 20 becomes tilted backward to a predetermined position so that the first and the second rollers 21, 22 massage the user in the back or the waist massage mode.

However, due to the massage heights of the first and the second rollers 21, 22 are set in advance, the massage device can not be adjusted based on the heights of the desired massage positions of different users. Moreover, the first and the second rollers 21, 22 swing at fixed angles individually, so the massage device can not massage every point of the curve line of the desired massage portion (such as the back or the waist) by ways of the same force.

The present invention has arisen to mitigate and/or obviate the afore-described disadvantages.

SUMMARY OF THE INVENTION

The primary object of the present invention is to provide a force sensing mechanism of a massage machine that reactions generated when the user contacts with the rollers are sensed by the force senescing mechanism to further sense the massage force, and then a sensing signal is transmitted to the controller so that when different portions of the human body are massaged, different reactions generate respectively, and the controller is capable of depicting every portion of the human body (such as the shoulder, the back, and the waist) to determine massage mode, thus increasing massage functions.

Another object of the present invention is to provide a force sensing mechanism of a massage machine that reactions generated when the user contacts with the rollers are sensed by the force senescing mechanism to further sense the massage force, and then a sensing signal is transmitted to the controller so that when different figures of the human bodies are massaged, different reactions of the points of the curve line generate respectively, and the controller is capable of depicting the curve line of the figure of the human body to provide the same force to massage every point of the curve line of the user.

In accordance with a first embodiment of the present invention, there is provided a force sensing mechanism of a massage machine contains:

a frame including a rotary shaft axially fixed thereon and displacing vertically on a second sliding rail of a massage chair;

a swing seat axially connected with the rotary shaft and including at least one roller, and a connecting member, a first end of the connecting member being axially coupled with the swing seat, and a second end of the connecting member being axially connected with a first end of a stopping member, a second end of the stopping member being axially coupled on the frame;

at least one sensing apparatus arranged on the frame relative to the stopping member so as to sense a movement of the stopping member, and the sensing apparatus being connected with a controller to transmit a sensing signal toward the controller so that the controller calculates a massage force of the at least one roller.

In accordance with a second embodiment of the present invention, there is provided a force sensing mechanism of a massage machine contains:

a frame including a rotary shaft axially fixed thereon and displacing vertically on a second sliding rail of a massage chair;

a swing seat axially connected with the rotary shaft and including at least one roller, between the frame and the swing seat being defined a fitting assembly, and the fitting assembly being axially coupled with a first end of a connecting member, a second end of the connecting member axially connected with a first end of a stopping member, a second end of the stopping member being axially coupled on the frame;

at least one sensing apparatus arranged on the frame relative to the stopping member so as to sense a movement of the stopping member, and the sensing apparatus being connected with a controller to transmit a sensing signal toward the controller so that the controller calculates a massage force of the at least one roller.

DETAILED DESCRIPTION OF THE PREFERRED EMBODIMENT

Figure 1:
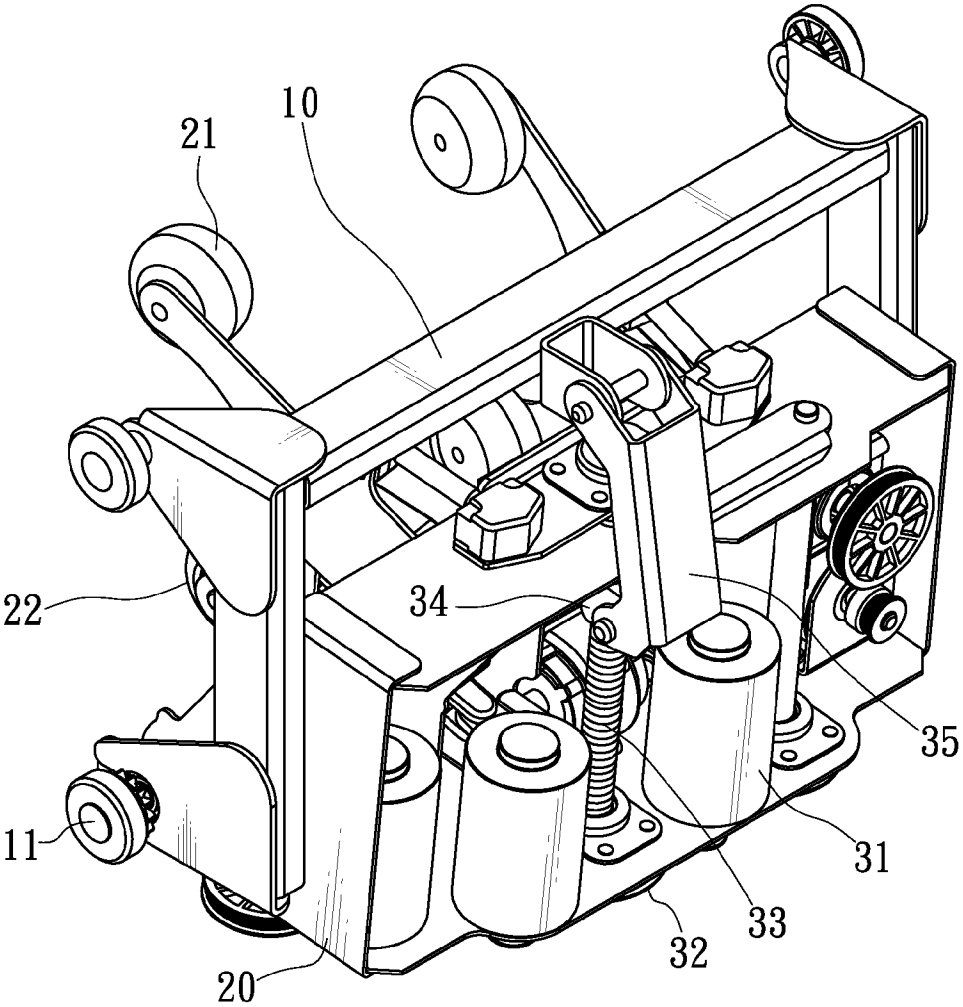
FIG. 1 PRIOR ART
FIG. 1 is a perspective view of a conventional angle adjusting mechanism of a massaging device of a massage machine disclosed in TW Pat. No. I326595.
Figure 2:
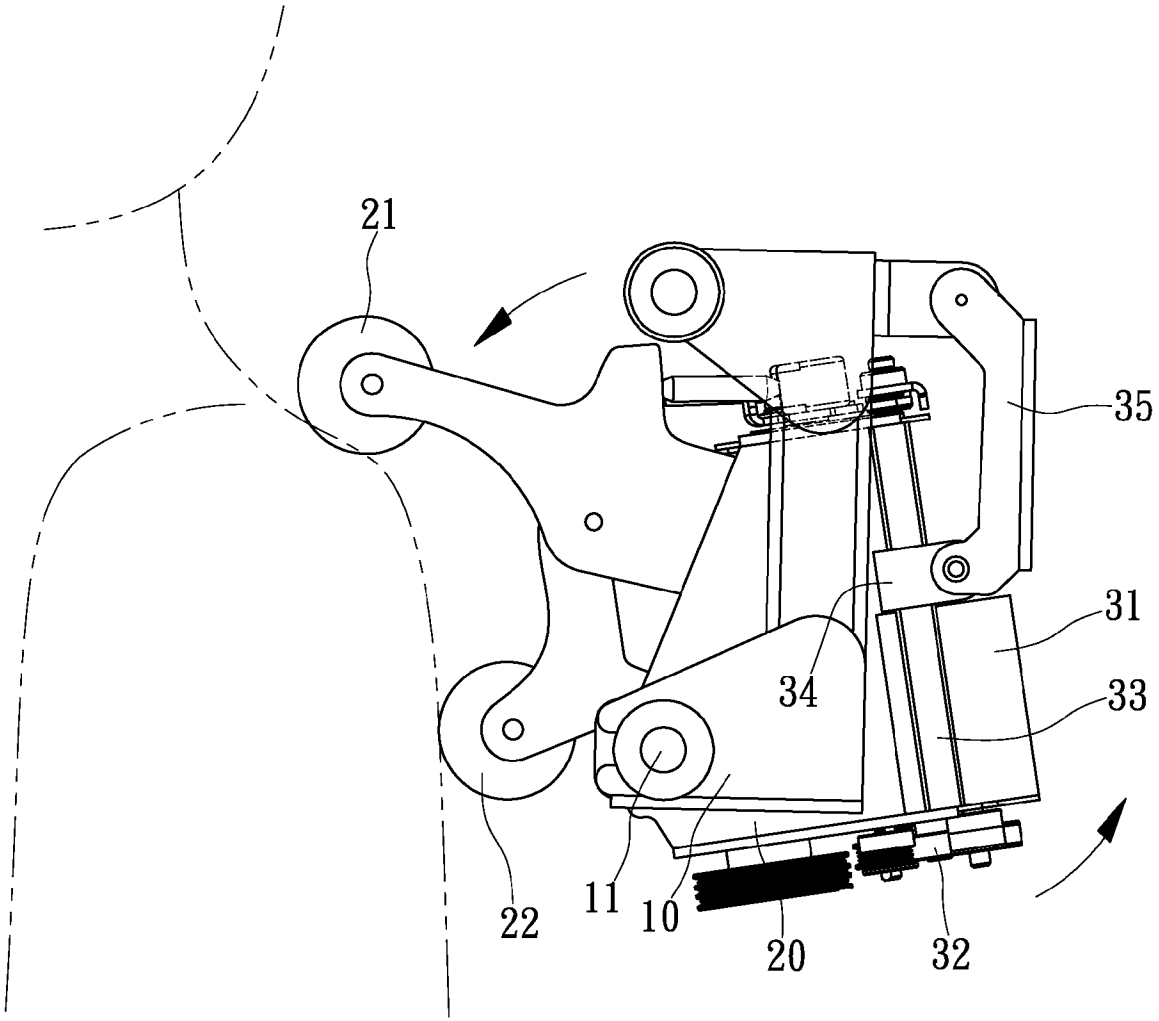
FIG. 2 PRIOR ART
FIG. 2 is a plan view showing the operation of the conventional angle adjusting mechanism of a massaging device of a massage machine disclosed in TW Pat. No. I326595.
Figure 3:
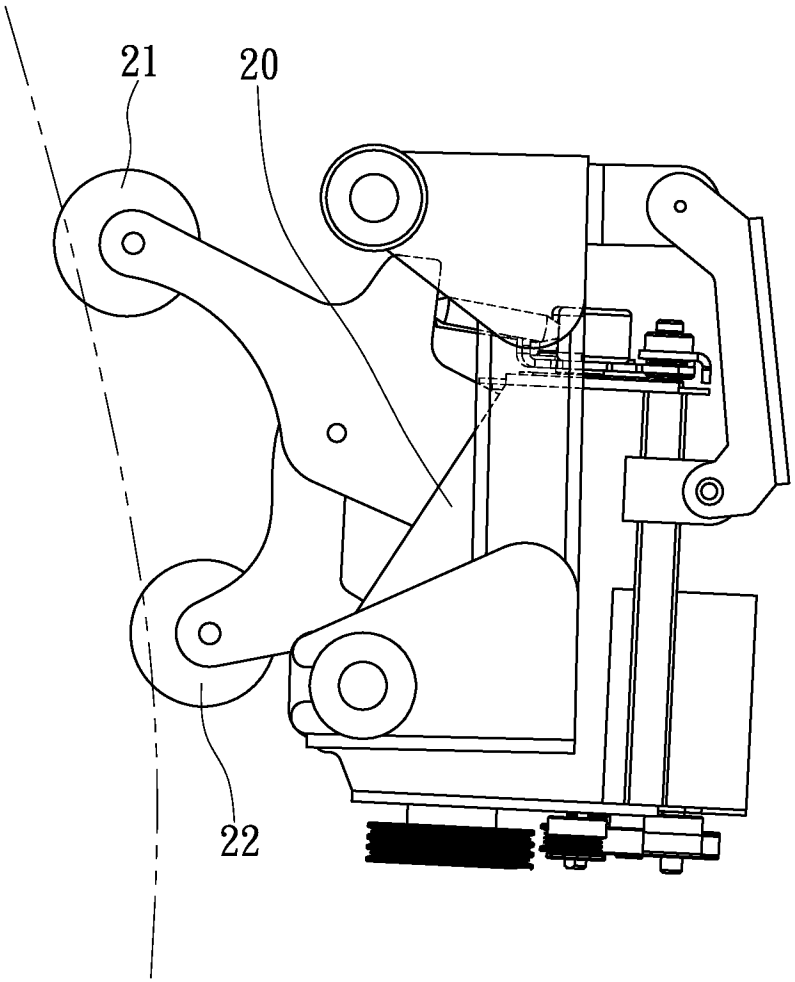
FIG. 3 PRIOR ART
FIG. 3 is another plan view showing the operation of the conventional angle adjusting mechanism.
Figure 4:
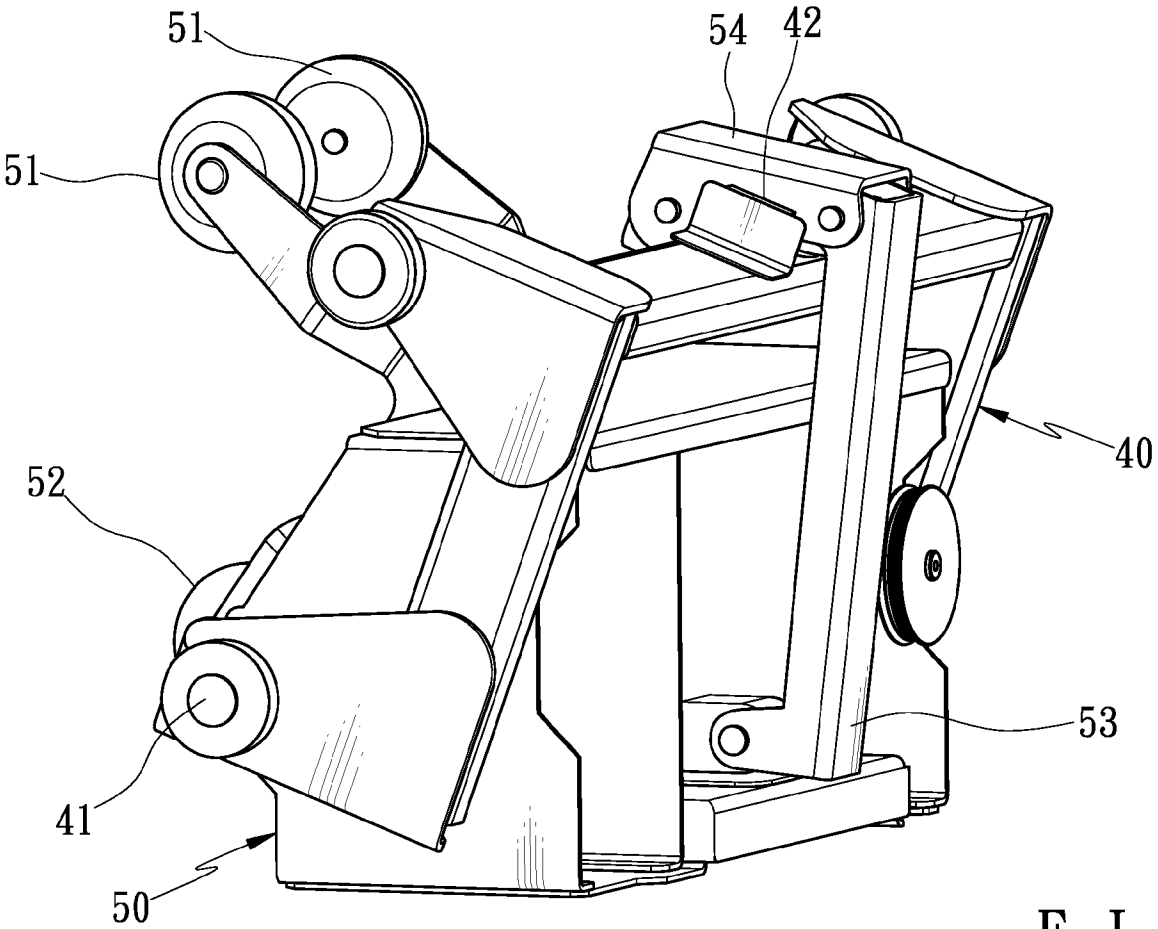
FIG. 4 is a perspective view showing the assembly of a force sensing mechanism of a massage machine according to a first embodiment of the present invention.
Figure 5:
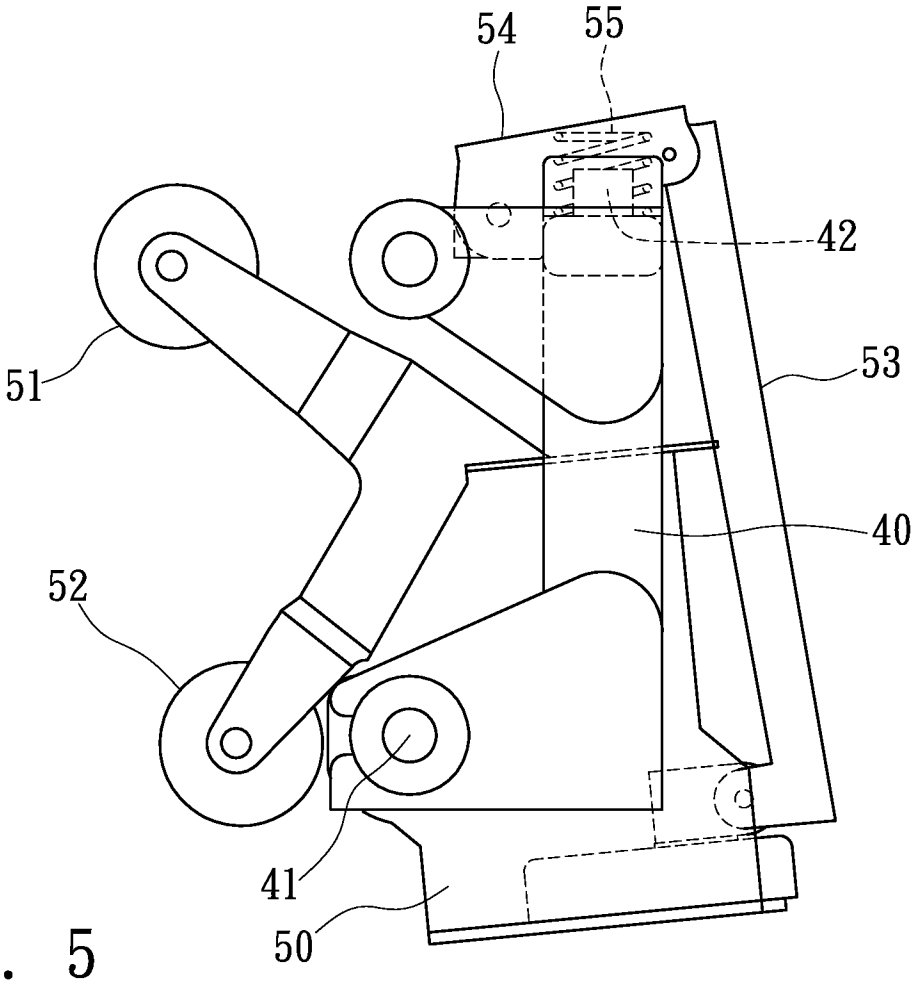
FIG. 5 is a plan view showing the assembly of the force sensing mechanism of the massage machine according to the first embodiment of the present invention.

Referring to FIGS. 4 and 5, a force sensing mechanism according to a first embodiment of the present invention is fixed on a massage machine having a frame 40, and the frame 40 is disposed on a first sliding rail of the massage machine to match with a vertical moving mechanism so that the frame 40 displaces vertically on a second sliding rail of a massage chair.

The massage machine of the first embodiment of the present invention comprises a rotary shaft 41 axially fixed on the frame 40 to connect with a swing seat 50 axially, and the swing seat 50 is axially connected with the rotary shaft 41 and includes at least one roller, wherein there are two first and two second rollers 51, 52 secured on the swing seat 50 respectively to massage a user; between the swing seat 50 and the frame 40 is defined the force sensing mechanism, and the force sensing mechanism includes a connecting member 53, a first end of which is coupled with the swig seat 50 axially; a stopping member 54, a first end of which is axially connected on a second end of the connecting member 53, a resilient element 55 disposed on the frame 40 to abut against the stopping member 54, and a second end of the stopping member 54 is axially coupled on the frame 40 so that the first and the second rollers 51, 52 of the swing seat 50 are pressed by the user, the first and the second rollers 51, 52 are pulled by the connecting member 53 to actuate the stopping member 54 to further press the resilient element 55, hence the first and the second rollers 51, 52 move and rotate, the frame 40 also includes at least one sensing apparatus 42 arranged thereon relative to the stopping member 54 so as to sense a movement of the stopping member 54, and the sensing apparatus 42 is connected with a controller (not shown). In this embodiment, the sensing apparatus 42 is at least one photoelectric sensor or Hall sensor to sense the movement of the stopping member 54 and to transmit a sensing signal toward the controller so that the controller calculates the massage force.

Figure 6:
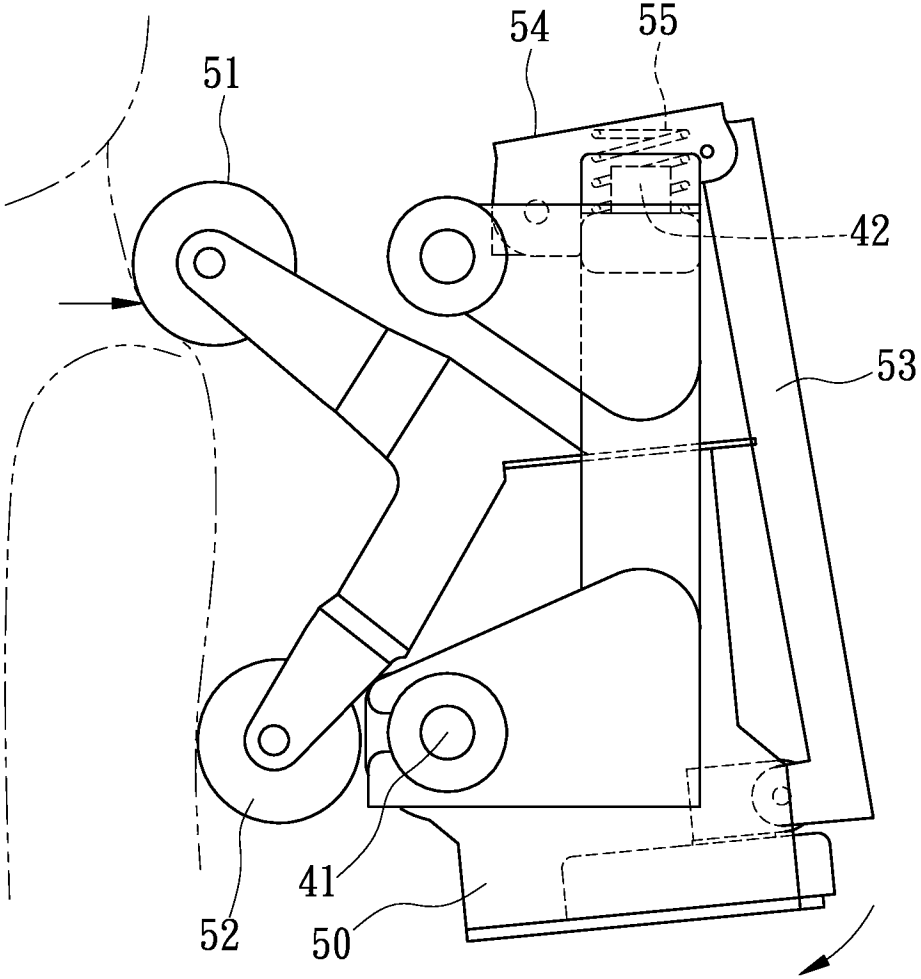
FIG. 6 is a plan view showing the operation of the force sensing mechanism of the massage machine according to the first embodiment of the present invention.

Referring to FIG. 6, when the user contacts with the first and the second rollers 51, 52 of the massage machine by using a shoulder, because a force of the shoulder to contact with the first rollers 51 is smaller, a smaller reaction actuates the swing seat 50 to rotate downward along the rotary shaft 41 so that the swing seat 50 actuates the stopping member 54 to press the resilient element 55 via the connecting member 53, such that the stopping member 54 rotates and displaces to be sensed by the sensing apparatus 42, thereafter the sensing signal is transmitted toward the controller to be further calculated, checked, and analyzed, thereby determining massaging positions of the first and the second rollers 51, 52.

Figure 7:
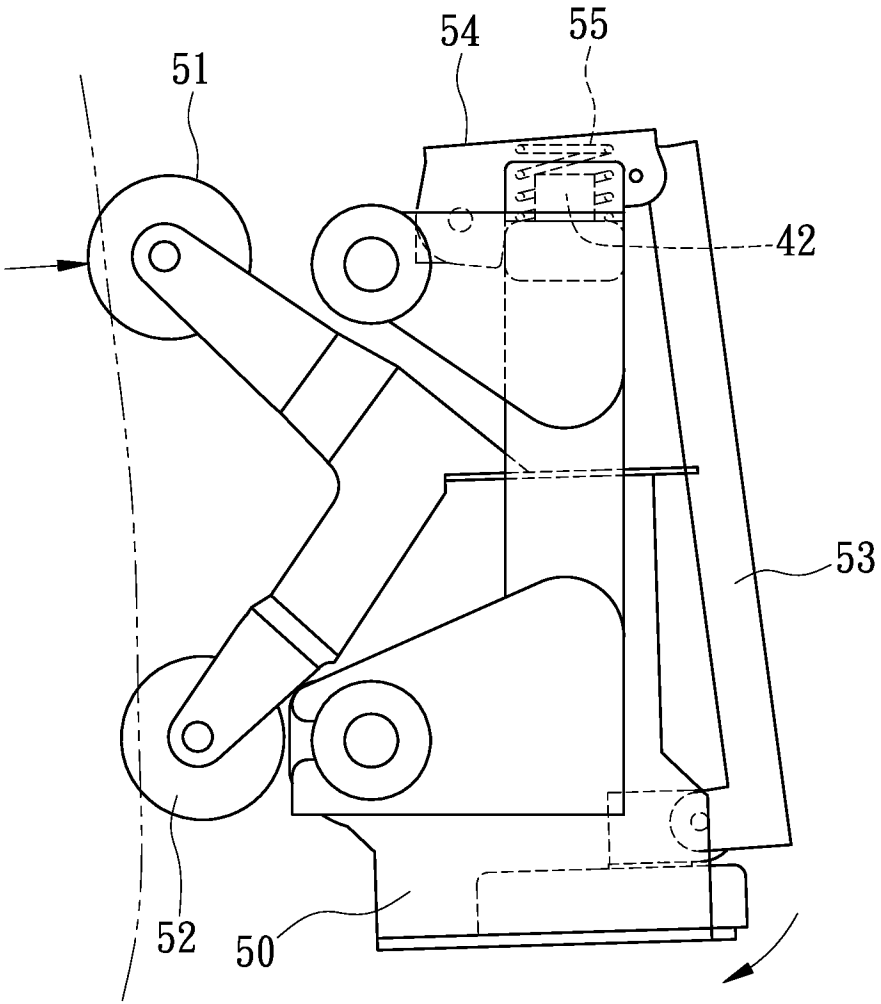
FIG. 7 is another plan view showing the operation of the force sensing mechanism of the massage machine according to the first embodiment of the present invention.

As shown in FIG. 7, when the user abuts against the first and the second rollers 51, 52 of the massage machine by ways of the back, due to the force of the back to abut against the first rollers 51 is larger, a larger reaction actuates the swing seat 50 to rotate downward along the rotary shaft 41 so that the swing seat 50 actuates the stopping member 54 to press the resilient element 55 through the connecting member 53, and then the sensing apparatus 42 senses a larger movement of the stopping member 54 and transmits the sensing signal toward the controller to be further calculated, checked, and analyzed by the controller, thus determining the massage positions of the first and the second rollers 51, 52. Thereby, other massage positions, such as the waist, are capable of being sensed and determined. In addition, the first and the second rollers 51, 52 are used to massage different portions of different users individually, and the controller is capable of depicting every portion of a human body (such as the shoulder, the back, and the waist) based on different reactions to determine massage mode (i.e. in a shoulder massage mode, a back massage mode or a waist massage mode), thus increasing massage functions.

Figure 8:
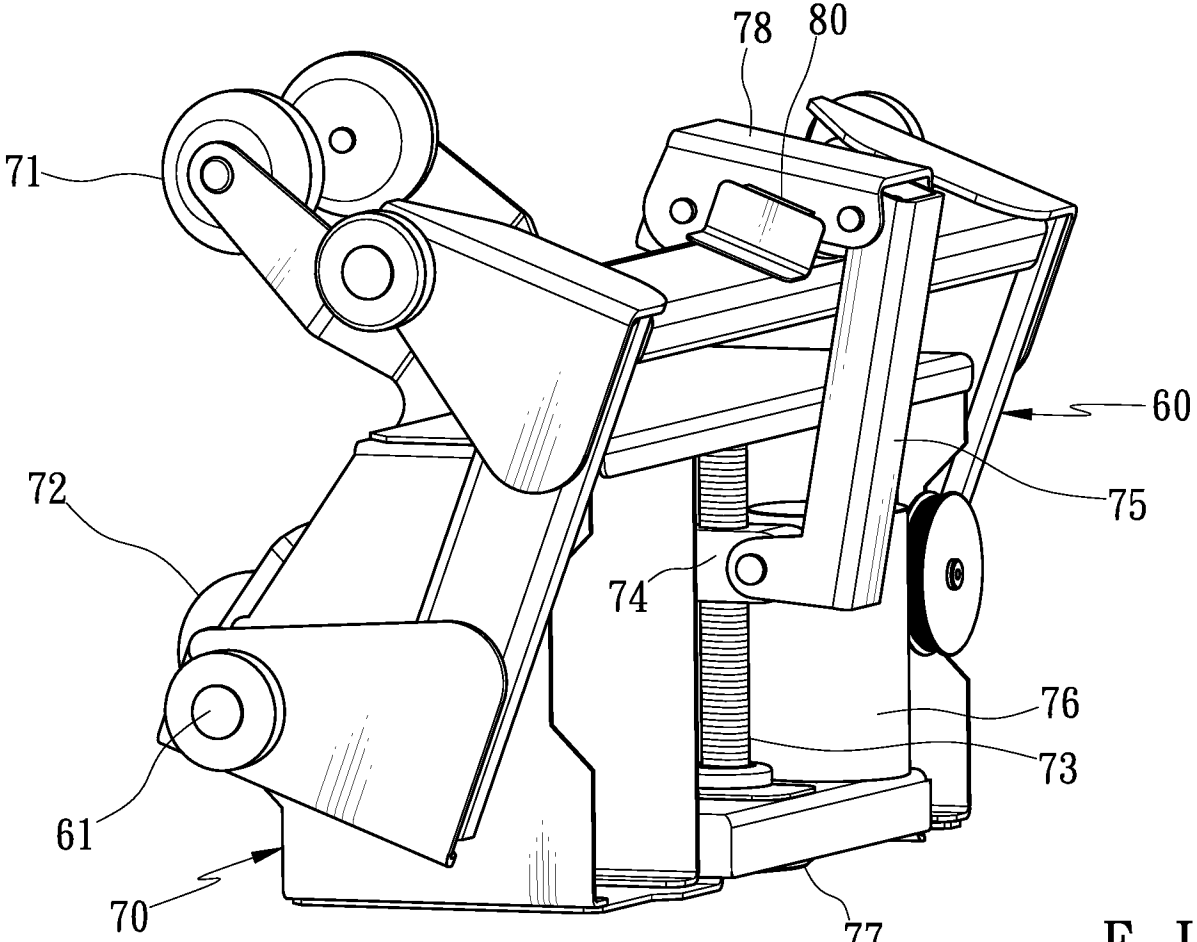
FIG. 8 is a perspective view showing the assembly of a force sensing mechanism of a massage machine according to a second embodiment of the present invention.
Figure 9:
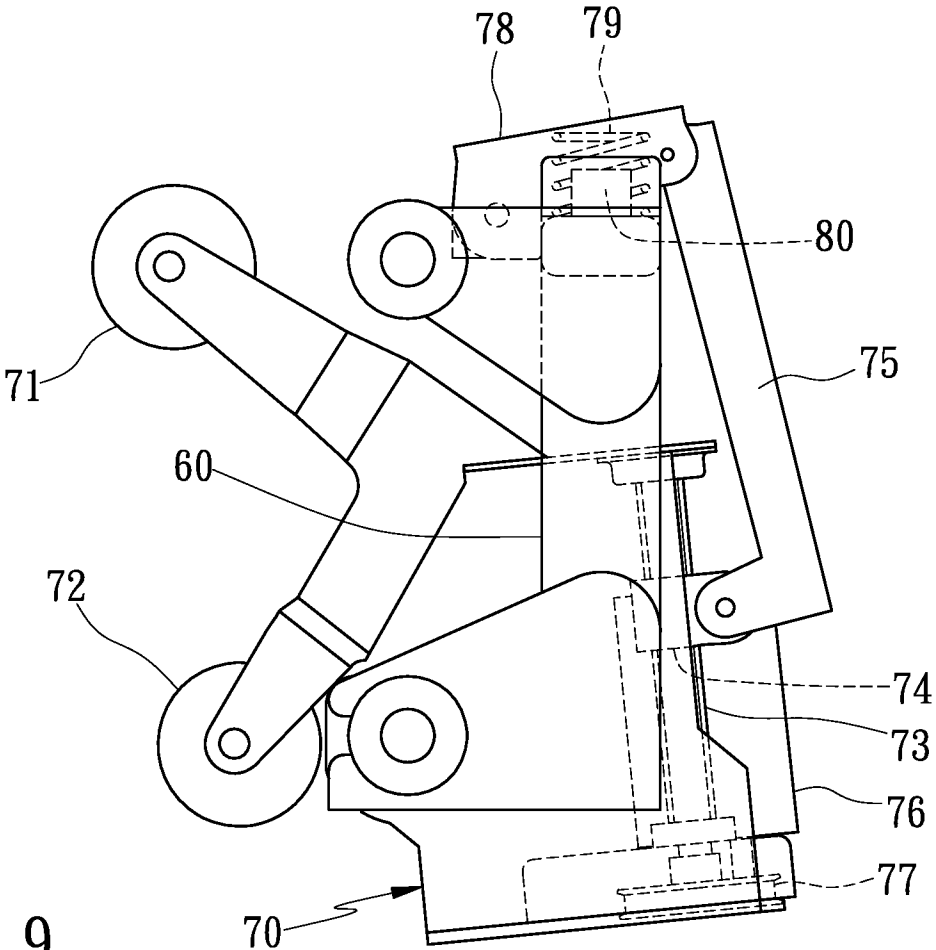
FIG. 9 is a plan view showing the assembly of the force sensing mechanism of the massage machine according to the second embodiment of the present invention.

As illustrated in FIGS. 8 and 9, a massage machine acceding to a second embodiment of the present invention includes a frame 60, and the frame 60 includes a rotary shaft 61 axially fixed thereof to connect with a swing seat 70 axially, the swing seat 70 includes at least one roller, wherein there are two first and two second rollers 71, 72 provided in this embodiment to massage a human body; between the swing seat 70 and the frame 60 are defined an angle adjusting mechanism and a force sensing mechanism, wherein the angle adjusting mechanism includes a fitting assembly defined between the frame 60 and the swing seat 70, a connecting member 75, and a driver to actuate the swing seat 70 to adjust an angle. The fitting assembly includes a screw rod 73 disposed on the swing seat 70 in a Z axis direction to screw with a sleeve 74, and the sleeve 74 is coupled with a first end of the connecting member 75 axially to connect with the frame 60 axially by using its first end, the driver is a motor 76 to drive the screw rod 73, wherein the motor 76 is disposed on the swing seat 70 and coupled with a pulley set 77 beneath the swing seat 70, the pulley set 77 is applied to drive the screw rod 70 to rotate, and the force sensing mechanism includes a stopping member 78, a first end of which is coupled with a second end of the connecting member 75, the stopping member 78 includes a resilient element 79 abutted thereagainst and fixed on the frame 60 and includes a second end axially connected with the frame 60 so that the first and the second rollers 71, 72 of the swing seat 70 actuate the stopping member 78 to press the resilient element 79 via the connecting member 75 while being pressed by the user , such that the stopping member 78 rotates and displaces, and the frame 60 also includes at least one sensing apparatus 80 secured thereon relative to the stopping member 78 so as to sense a movement of the stopping member 78, the sensing apparatus 80 is connected with a controller (not shown). In this embodiment, the sensing apparatus 80 includes at least one photoelectric sensor or Hall sensor to sense the movement of the stopping member 78 and to transmit a sensing signal toward the controller so that the controller calculates the massage force.

Figure 10:
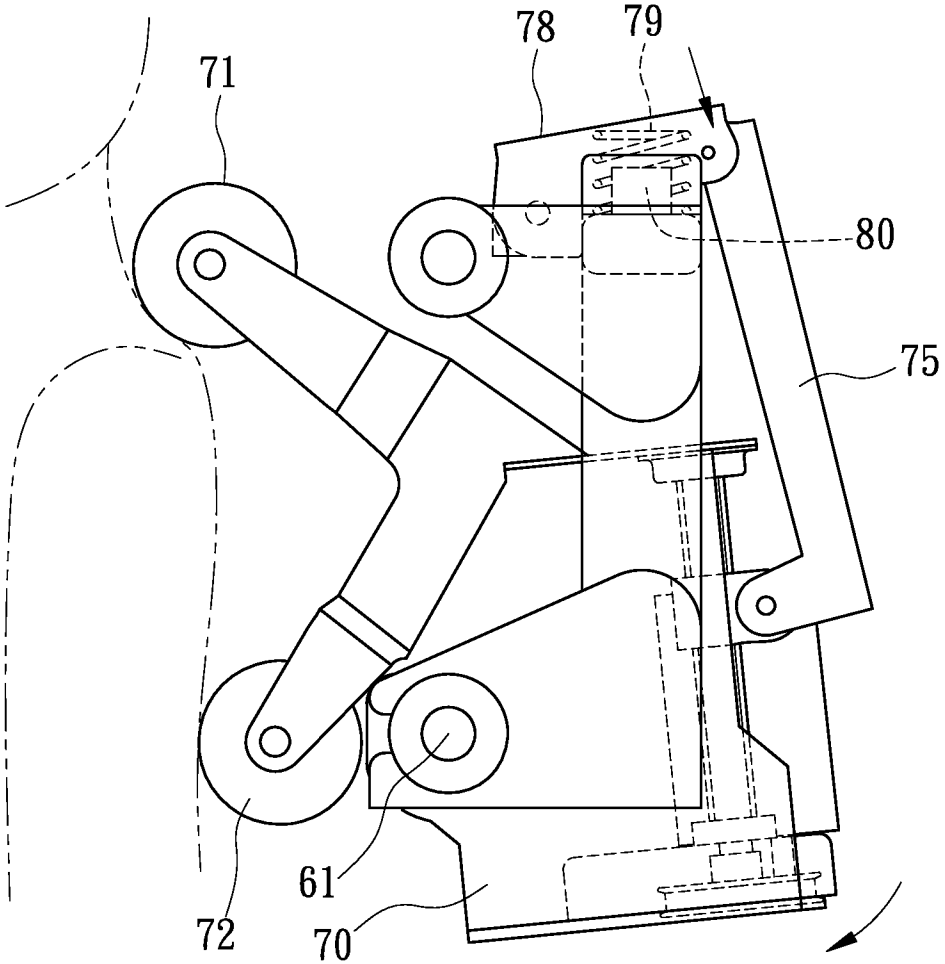
FIG. 10 is a plan view showing the operation of the force sensing mechanism of the massage machine according to the second embodiment of the present invention.

Referring to FIG. 10, when the user contacts with the first and the second rollers 71, 72 of the massage machine by using a shoulder, because a force of the shoulder to contact with the first rollers 71 is smaller, a smaller reaction actuates the swing seat 70 to rotate downward along the rotary shaft 61 so that the swing seat 70 actuates the stopping member 78 to press the resilient element 79 via the connecting member 75, such that the stopping member 78 rotates and displaces to be sensed by the sensing apparatus 80, thereafter the sensing signal is transmitted toward the controller to be further calculated, checked, and analyzed, thereby determining massaging positions of the first and the second rollers 71, 72.

Figure 11:
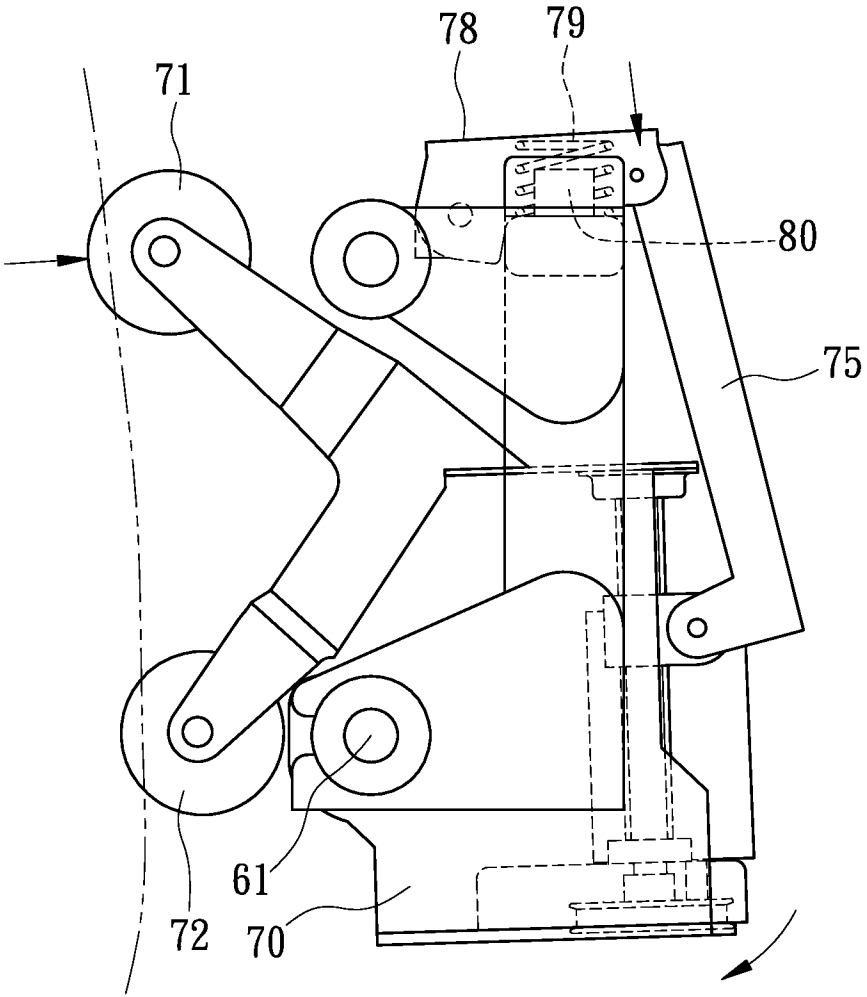
FIG. 11 is another plan view showing the operation of the force sensing mechanism of the massage machine according to the second embodiment of the present invention.

As shown in FIG. 11, when the user abuts against the first and the second rollers 71, 72 of the massage machine by ways of the back, due to the force of the back to abut against the first rollers 71 is larger, a larger reaction actuates the swing seat 70 to rotate downward along the rotary shaft 61 so that the swing seat 70 actuates the stopping member 78 to press the resilient element 79 through the connecting member 75, then the sensing apparatus 80 senses a larger movement of the stopping member 78 and transmits the sensing signal toward the controller to be further calculated, checked, and analyzed by the controller, thus determining the massage positions of the first and the second rollers 71, 72. Thereby, other massage positions, such as the waist, are capable of being sensed and determined. In addition, the first and the second rollers are used to massage different portions of different users individually, and the controller is served to depict every portion of the human body (such as the shoulder, the back, and the waist) based on different reactions to determine massage mode (i.e. in a shoulder massage mode, a back massage mode or a waist massage mode), thus increasing massage functions.

Figure 12:
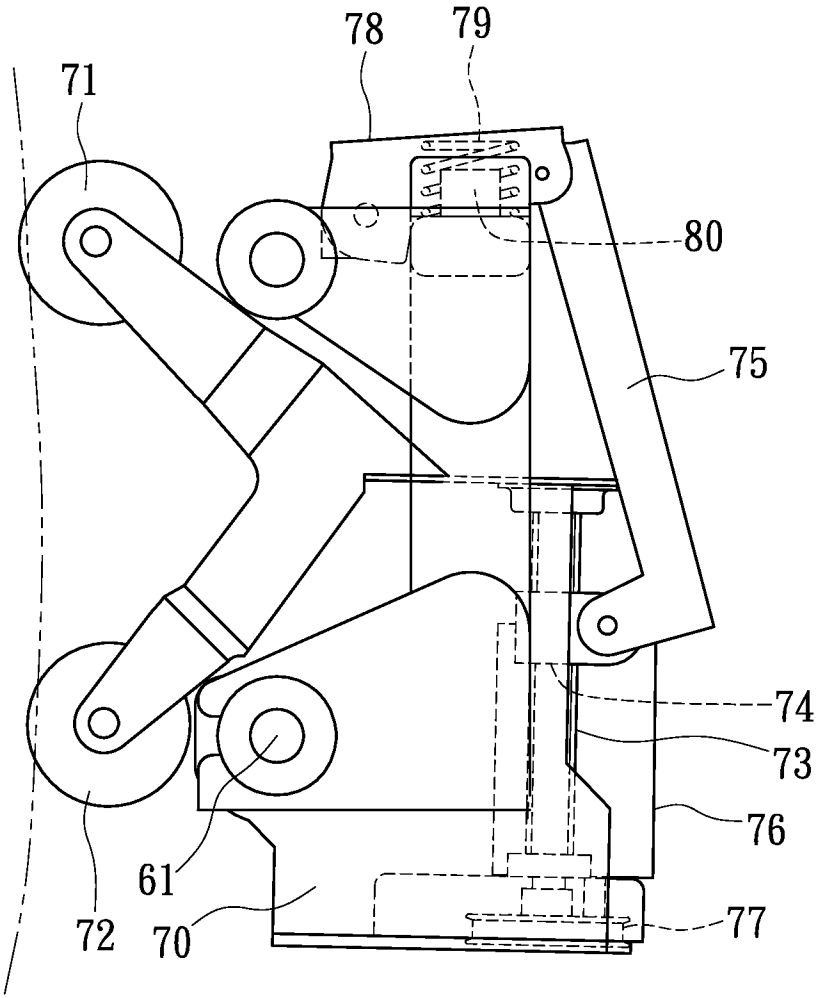
FIG. 12 is also another plan view showing the operation of the force sensing mechanism of the massage machine according to the second embodiment of the present invention.

With reference to FIG. 12, when the user's figure is more curved, for example, every point of the curve line of the waist is not located at the same straight line, the first and the second rollers 71, 72 move vertically on the same straight line, so every point of the curve line of the waist can not be massaged by the same force. In other words, the massage machine can not massage the user by means of the same force with a change of the curve line of the hanuman body. However, when the first and the second rollers 71, 72 of the force sensing mechanism of the present invention massage the projected positions of the curve line of the human body, because the projection positions abut against the first rollers 71 with a larger force, the larger reactions generate to actuate the swing seat 70 to rotate downward along the rotary shaft 61 so that the swing seat 70 actuates the stopping member 78 to press the resilient element 79 through the connecting member 75, and then the sensing apparatus 80 senses a larger movement of the stopping member 78 and transmits the sensing signal toward the controller to be further calculated, checked, and analyzed, wherein if the forces of the first and the second rollers 71, 72 to massage the projected positions are heavy, a swing angle of the swing seat 70 is adjusted so that the motor 76 drives the screw rod 73 to move downward along the sleeve 74 via the pulley set 77, such that the screw rod 73 pulls the swing seat 70 to swing outward by using the rotary shaft 41 as its fulcrum, and the connecting member 75 and the stopping member 78 cooperate with the swing angle of the screw rod 73 to actuate the first and the second rollers 71, 72 so that massage angles of the first and the second rollers 71, 72 are adjusted, thus changing force to massage the projected positions of the curve line of the human body.

Figure 13:
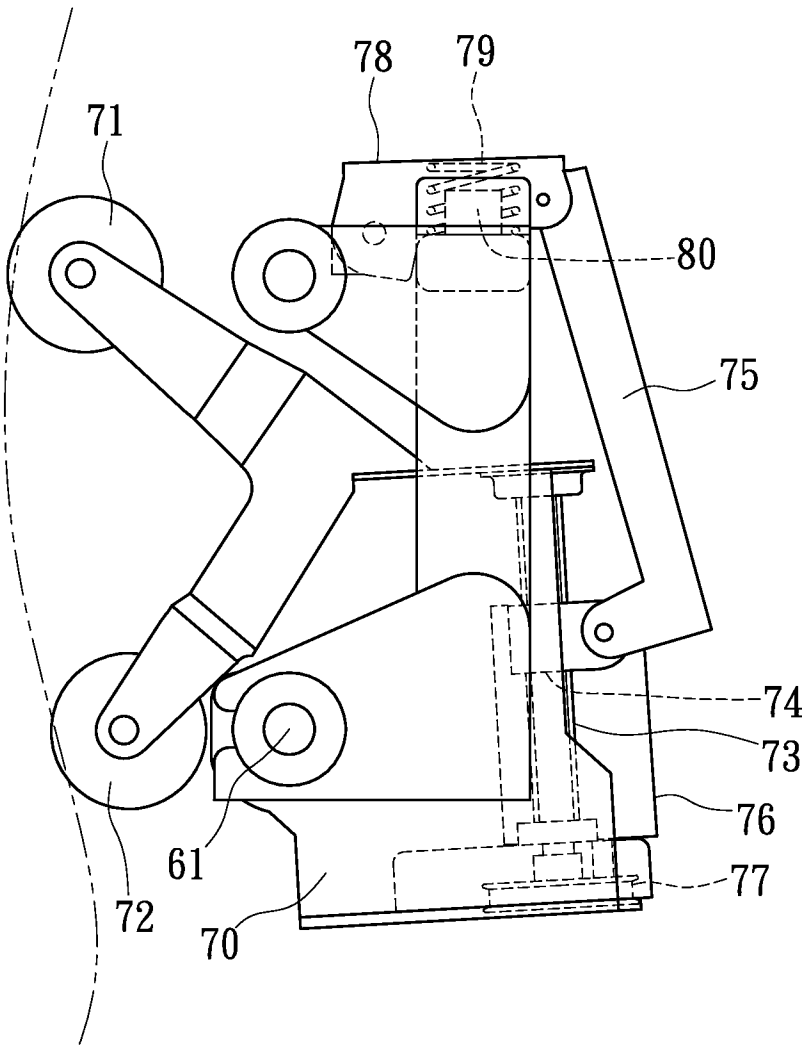
FIG. 13 is still another plan view showing the operation of the force sensing mechanism of the massage machine according to the second embodiment of the present invention.

As shown in FIG. 13, when the first and the second rollers 71, 72 of the force sensing mechanism massage concaved positions of the curve line of the human body, since the forces of the concaved positions to contact with the first rollers 71 are smaller, smaller reactions actuate the swing seat 70 to rotate downward along the rotary shaft 61 so that the swing seat 70 actuates the stopping member 78 to press the resilient element 79 through the connecting member 75, and then the stopping member 78 rotates and moves to be sensed its smaller movement by the sensing apparatus 80, thereafter the sensing signal is transmitted toward the controlled to be calculated, cheeked, and analyzed. If the forces of the first and the second rollers 71, 72 to massage the concaved positions are light, the swing seat 70 is adjusted its swing angle so that the motor 76 drives the screw rod 73 to displace upward along the sleeve 74 via the pulley set 77, thereafter the screw rod 73 pulls the swing seat 70 to swing inward by using the rotary shaft 61 as its fulcrum, such that the connecting member 75 and the stopping member 78 cooperate with a swing angle of the screw rod to be adjusted so that the forces of the first and the second rollers 71, 72 to massage the concaved positions of the curve line are adjusted, thereby massaging every portions of the curve line evenly.

The invention is not limited to the above embodiment but various modifications thereof may be made. It will be understood by those skilled in the art that various changes in form and detail may made without departing from the scope and spirit of the present invention.

What is claimed is:

1. A force sensing mechanism of a massage machine comprising:

a frame including a rotary shaft axially fixed thereon and displacing vertically on a second sliding rail of a massage chair;

a swing seat axially connected with the rotary shaft and including at least one roller, and a connecting member, a first end of the connecting member being axially coupled with the swing seat, and a second end of the connecting member being axially connected with a first end of a stopping member, a second end of the stopping member being axially coupled on the frame;

at least one sensing apparatus arranged on the frame relative to the stopping member so as to sense a movement of the stopping member, and the sensing apparatus being connected with a controller to transmit a sensing signal toward the controller so that the controller calculates a massage force of the at least one roller.

2. The force sensing mechanism of the massage machine as claimed in claim 1, wherein the frame includes a resilient element disposed thereon to abut against the stopping member.

3. The force sensing mechanism of the massage machine as claimed in claim 1, wherein the at least one sensing apparatus is at least one photoelectric sensor.

4. The force sensing mechanism of the massage machine as claimed in claim 1, wherein the at least one sensing apparatus is at least one Hall sensor.

* * * * *